US005125589A

United States Patent [19]

Manusch

[11] Patent Number: 5,125,589

[45] Date of Patent: Jun. 30, 1992

[54] TAPE DISPENSER WITH CONTROLLED-FRICTION UNWIND

[75] Inventor: Christoph Manusch, Hemmingen, Fed. Rep. of Germany

[73] Assignee: Pelikan AG, Hanover, Fed. Rep. of Germany

[21] Appl. No.: 491,738

[22] Filed: Mar. 12, 1990

[30] Foreign Application Priority Data

Mar. 10, 1989 [DE] Fed. Rep. of Germany ..... 3907753

[51] Int. Cl.[5] ..... B65H 23/00; B65H 77/00

[52] U.S. Cl. ..... 242/67.30 R; 242/75.46; 242/75.47; 156/577

[58] Field of Search ..... 242/67.3 R, 75.4, 75.46, 242/75.47, 55.2, 55.53, 75.45; 156/577; 188/375, 83, 68, 250 R

[56] References Cited

U.S. PATENT DOCUMENTS

| | | | |
|---|---|---|---|
| 1,849,383 | 3/1932 | Richardson et al. | 242/75.47 |
| 2,277,134 | 3/1942 | Nelson | 188/83 |
| 2,859,919 | 11/1958 | Debrie | 242/71.8 |
| 2,905,404 | 9/1959 | Simmons | 242/55.2 |
| 3,106,324 | 10/1963 | Fritzinger | 242/55.53 |
| 3,149,702 | 9/1964 | Popper | 188/83 |
| 3,156,324 | 11/1964 | Colbert | 188/83 |
| 3,434,570 | 3/1969 | Freholm | 188/83 |
| 3,902,956 | 9/1975 | Thompson, Jr. | 156/577 |
| 4,849,064 | 7/1989 | Manusch et al. | 156/577 |

FOREIGN PATENT DOCUMENTS

| | | | |
|---|---|---|---|
| 3736357 | 11/1988 | Fed. Rep. of Germany . | |
| 2501158 | 9/1982 | France . | |
| 487431 | 6/1938 | United Kingdom | 188/250 R |

*Primary Examiner*—Daniel P. Stodola
*Assistant Examiner*—John Q. Nguyen
*Attorney, Agent, or Firm*—Herbert Dubno; Andrew Wilford

[57] ABSTRACT

A dispenser for a film carried on a tape has a cartridge in which is rotatable a supply spool on which the tape carrying the film is wound and a takeup spool onto which the tape is also wound. The cartridge further has a guide over which the tape passes between the spools and a one-way clutch or brake engaged between the takeup spool and the cartridge for permitting the takeup spool to rotate only in a direction winding up the tape. A brake is provided that resists rotation of the supply spool on the cartridge in a direction corresponding to unwinding of the tape from the supply spool with a force that, after a predetermined number of revolutions of the spool, decreases as the tape is unwound from the supply spool.

18 Claims, 2 Drawing Sheets

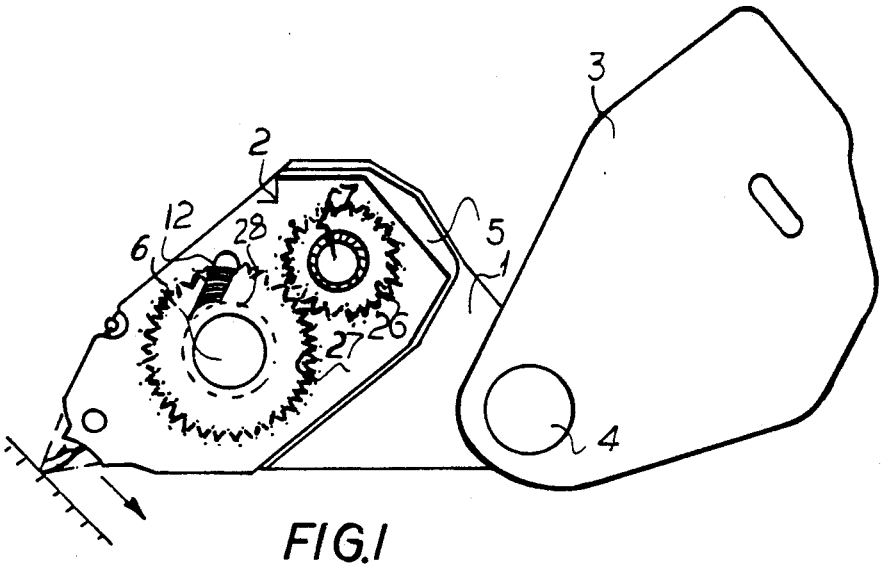
FIG.1
FIG.2
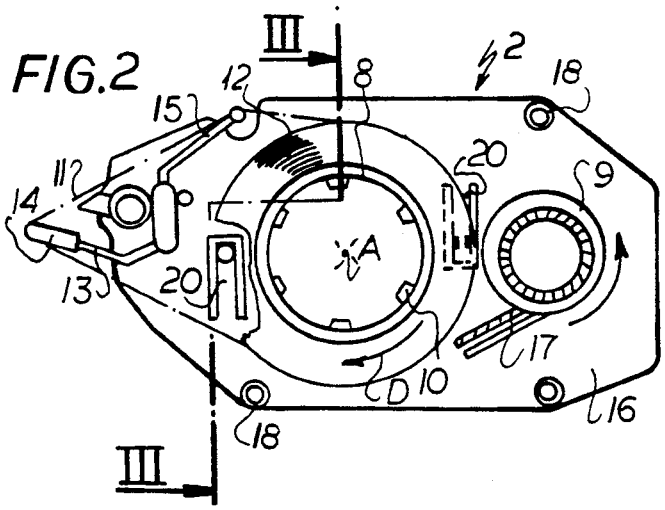
FIG.3
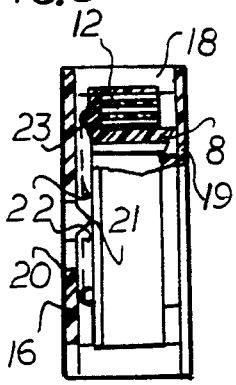
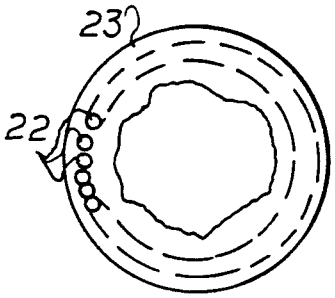
FIG.4
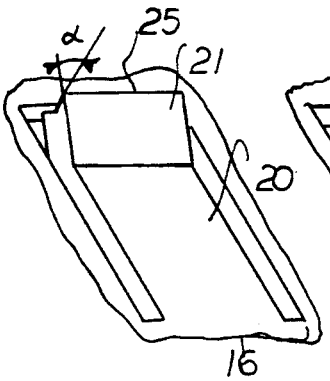
FIG.5
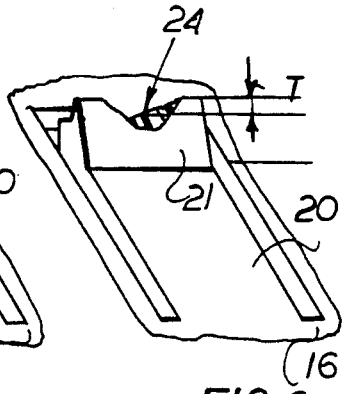
FIG.6

TAPE DISPENSER WITH CONTROLLED-FRICTION UNWIND

FIELD OF THE INVENTION

The present invention relates to a hand-held tape dispenser. More particularly this invention concerns such a dispenser wherein a film is pulled from a backing tape as it is used and the backing tape is automatically wound back up in the dispenser.

BACKGROUND OF THE INVENTION

A standard hand-operated device for transferring a film from a carrier tape to a substrate has a housing made of two parts that are pivoted together. The housing has two rotatable spindles coupled to each other by a slip-permitting transmission. A cartridge is held in this housing and has fitting on the pivot pins a supply spool and a takeup spool for the tape and an applicator element at one end. The tape passes from the supply spool over the applicator element which is used to press the tape against the substrate for transfer of the film from the tape to the substrate. After the film is stripped from the tape, this tape is wound up on the takeup spool which itself is provided with a one-way brake allowing it to rotate only in one direction. Such an arrangement is described in commonly owned U.S. Pat. Nos. 4,849,064 and 4,853,074.

The film is often an adhesive layer acting in effect like a double-faced tape. After the adhesive film is stripped from the carrier tape, same passes back over the supply of the tape on the spool, inherently sticking somewhat to same although the tape itself has such a smooth surface that adherence is weak, so that the tape will remain fairly snug along its path over the applicator element. When, however, the film is an opaque cover-up having a face covered with contact adhesive, the outer surface of the supply spool is constituted by the smooth non-sticky face of this cover-up film so that until the cartridge is mounted in the holder, it is possible for the tape to loosen and form a slack loop because the only thing preventing reverse rotation of the supply spool is the one-way brake of the takeup spool which is effective through gearing and a slip clutch on the supply spool. Unless the user meticulously tightens the tape before loading the cartridge in the holder, this loose loop will make subsequent application of the film to a substrate difficult or impossible.

Some means is normally provided to keep some tension in the tape so that it can be applied accurately, and also to create some tension in the tape when same has loosened as described above. This is most easily done by setting the transmission ratio of the gearing driving the takeup spool from the supply spool such that the takeup spool always rotates at least a little bit faster than the supply spool, and by providing a slip clutch in this transmission that itself creates the desired tension. The diameter of the supply spool decreases and that of the takeup spool increases proportionately as the supply is used up, so that the slip must be at a minimal level at the very end of the life of the cartridge, when the supply is exhausted. If the tension is too great at the end, the tape will snap. On the other hand the varying lever arms created by the changing diameters of the supply and takeup spools means that the tension created by the slip clutch invariably provided between the large-diameter supply spool and its coaxial drive gear will inherently increase as the supply is used up. Thus to start with the tension will be very low so that a loose loop in the tape will not be eliminated or one can even be created. Of course once the tape is used up the increasing tension will normally rectify the problem, even if, for instance, a cartridge is taken off the holder and then put back on with its tape somewhat loose.

In order to prevent the tape in a cartridge for a typewriter or printer from loosening prior to installation it is known to fit the legs of a disposable U-shaped piece of cardboard or the like into the spools, so as to prevent same from rotating prior to installation. If the cartridge is not installed in the holder immediately after this element is removed, however, the tape can loosen, or if one cartridge is swapped out for another to change film colors or the like, loosening can occur, as the retaining strip is normally discarded.

Another known system has a brake that acts continuously on one or both of the spools. Such a brake is typically formed as an integral elastically deformable tab that projects from the cartridge and bears on the spool. The friction between this tab and the spool therefore brakes the spool and prevents it from rotating freely. Unfortunately with such a system the braking force normally increases as the tab wears and the surface area with which it bears on the spool increases. Such increased braking force can result in breakage of the tape toward the end of the life of the cartridge. In addition while this increasing braking action is not significant in a motor-driven system, it is noticeable in a hand-held dispenser and makes such a dispenser harder to use, as sometimes it takes considerable force to apply a film with it and other times it takes relatively little force.

OBJECTS OF THE INVENTION

It is therefore an object of the present invention to provide an improved film dispenser.

Another object is the provision of such an improved film dispenser which overcomes the above-given disadvantages, that is which prevents the tape from loosening in the cartridge even before same is installed in the holder, and which also provides a braking action which is exactly tailored for the requirements of the dispenser itself.

Another object is to provide an improved cartridge which can be used in the above-described standard holder but which has the advantages described immediately above.

SUMMARY OF THE INVENTION

A dispenser for a film carried on a tape according to this invention has a cartridge in which is rotatable a supply spool on which the tape carrying the film is wound and a takeup spool onto which the tape is also wound. The cartridge further has a guide over which the tape passes between the spools and a one-way clutch or brake engaged between the takeup spool and the cartridge for permitting the takeup spool to rotate only in a direction winding up the tape. According to this invention a brake is provided that resists rotation of the supply spool on the cartridge in a direction corresponding to unwinding of the tape from the supply spool with a force that, after a predetermined number of revolutions of the spool, decreases as the tape is unwound from the supply spool.

The system of this invention therefore resists loosening of the tape initially with sufficient force that it remains taut in the cartridge. As, however, the tape is used and the diameter of the supply spool decreases, the braking action correspondingly decreases to maintain a constant tension in the tape. At the beginning when the relative rotation differences that are compensated for by the slip clutch are minor, the braking force is high to compensate, but near the end of the supply when they are great the braking force is low and the slip clutch is responsible for maintaining tension. The system of this invention can be incorporated inside an otherwise standard cartridge usable in a standard holder so that the benefits of this invention can be applied to already existing equipment.

In accordance with this invention the brake includes a braking element on and rotatable with the spool and a braking element on the cartridge. These elements are frictionally engaged with each other and at least one of the elements is of a material which wears away as the spool rotates. However in the inventive system, as the one element wears away the friction between it and the other element decreases, thereby decreasing the braking force. This effect is easily achieved by forming the spool braking element as an annular array of detents projecting axially or radially from the supply spool and the cartridge braking element as a tooth engageable with the detents and carried on a biasing element that urges the tooth into engagement between the detents. As the tooth is worn down by the detents the braking force decreases until there is virtually no more braking effect, only the slip clutch being effective at the end of the life of the cartridge for supplying tension.

More specifically according to this invention the tooth is pointed and engageable between the detents, the biasing means is a tongue integrally formed on the cartridge and the supply spool has a side disk integrally formed with the detents. The tooth is unitarily formed with the tongue and is of triangular section with flanks meeting at an edge and defining an angle lying generally between 30° and 60°, the sharper angle giving a quicker falloff in braking force. Both the detents and tooth can be formed of a synthetic resin, for instance a styrol-butadiene copolymer or polyolefin that is easily injection molded. It is also within the scope of this invention to make the detents more wear resistance, for instance of metal. The detents can themselves be of conical shape.

The supply spool of this invention is rotatable about and the array is centered on a common axis and the tongue extends tangentially of the axis at the array. Thus the tooth engages centrally between the detents The cartridge can have two or more such tongues and teeth angularly equispaced about the axis.

DESCRIPTION OF THE DRAWING

The above and other objects, features, and advantages will become more readily apparent from the following, reference being made to the accompanying drawing in which:

FIG. 1 is a side view of the dispenser according to this invention;

FIG. 2 is a top view of the cartridge in accordance with this invention with one side plate removed for clarity of view;

FIG. 3 is a section taken along line III—III of FIG. 2;

FIG. 4 is a bottom view of a part of the supply spool according to the invention;

FIGS. 5 and 6 are large-scale perspective views of a detail of this invention when new and after considerable use;

SPECIFIC DESCRIPTION

Figure 7:
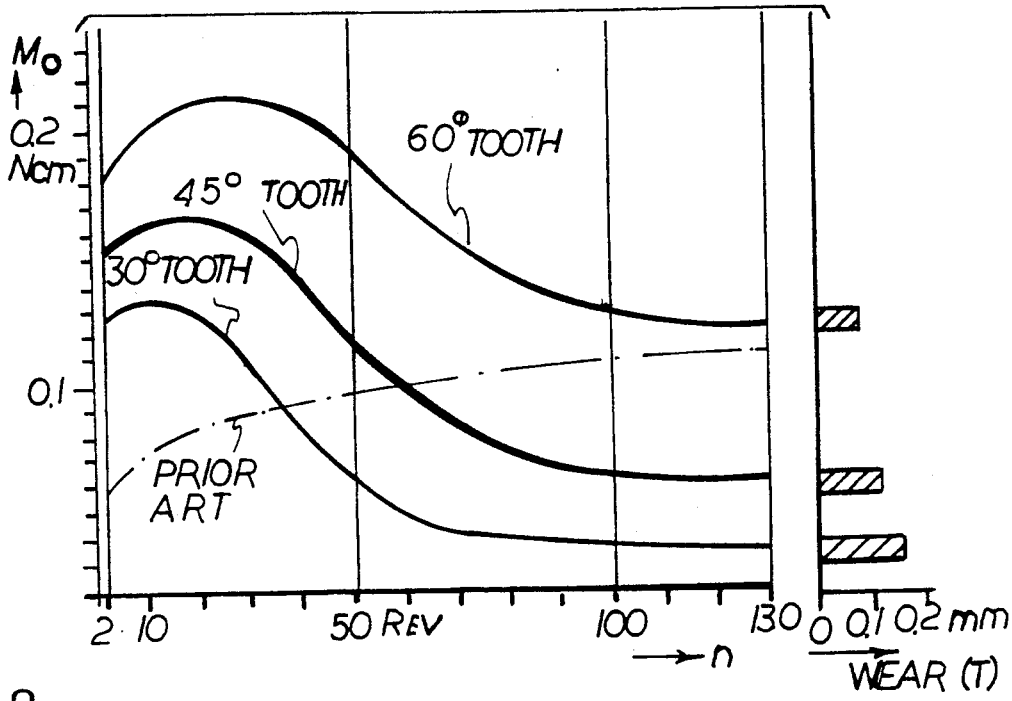
FIG. 7 is a pair of graphs illustrating the functioning of the instant invention.

As seen in FIG. 1 a dispenser holder 1 of the type described in above-cited commonly owned U.S. Pat. Nos. 4,853,074 and 4,849,064 to which reference should be made for further details has a cover 3 pivoted at 4 on one end of the holder 1 and is provided with a replaceable and disposable tape cartridge 2. Drive spindles 6 and 7 inside the holder I are connected together by gears 26 and 27 and by a friction clutch 28 between the gear 27 and the spindle 6 so that rotation of the spindle 6 will rotate the spindle 7 with some possibility of relative slip.

The cartridge 2 itself has a bottom side plate 16 held by spacers 18 off a top side plate 19 as shown in FIGS. 2 and 3 and comprises a large-diameter supply spool 8 provided internally with teeth 10 that couple it to the spindle 6 and a further smaller-diameter spool 9 adapted to similarly fit on the spindle 7 so that when the cartridge 2 is installed the spools 8 and 9 are locked to the respective spindles 6 and 7. A tape 11 is pulled in a direction D from a supply 12 wound on the spool 8 and passes in the direction of arrow D over an applicator or guide bar 14 carried on an applicator arm 13 and then passes back over the supply 12 and is wound up on the spool 9. A film is stripped from the tape 11 at the applicator bar 14 in the manner known per se. A tensioning element 15 is provided to keep the tape 11 taut and a brake 17 is provided for preventing reverse rotation of the spool 9 and loosening of the tape 11. This brake 17 is a flexible tab engaging tangentially in teeth on the spool 9 as described in the above-cited patents.

In accordance with this invention the spool 8 has an annular and planar end plate 23 confronting the bottom side plate 16 and unitarily formed with a circular array of frustoconical bumps 22. The plate 16 is formed unitarily with two biasing tongues 20 each projecting tangentially of the array of bumps 22 in the rotation direction D. The free end of each of these biasing tongues 20 is formed with a V-shaped tooth 21 having a sharp linear edge 25 that extends radially of the rotation axis A of the spool 8. The flanks that define this edge 25 are planar and extend at an angle $\alpha$ of between 30° and 60°, here at 45°, to each other.

Both the spool 8 and the plate 16 are made of the same synthetic resin, here Vestyron 512 TM. This resin has a penetration strength according to German Industrial Norm (DIN) 53,481 of at least 50 kV/mm, a bending limit tension according to DIN 53,452 with a #2 normal bar of 600 kp/cm$^2$, a modulus of elasticity according to DIN 53,457 with a tension test according to DIN 53,455 of 28,000 kp/cm$^2$, as well as a notch-impact ductility (impact-bending test according to Charpy, DIN 53,453 with a #2 standard bar at +20° C.) of 4 cmkp/cm$^2$.

Since there are a multiplicity of the detents 22 and only one tooth 21, and since the tooth 21 has a sharp edge, this tooth 21 will become abraded or worn away as seen at the notch 24 in FIG. 6. This notch 24 in turn will have a depth T that will be directly proportional to how worn it is, that is to how many times the spool 8 has rotated around its axis A. The more worn down the tooth 21 is, the less the finger 20 will be deflected, so that the braking force effective on the spool 8 will decrease correspondingly as the notch 24 deepens When the notch 24 is so deep that the detents 22 can pass through it without substantial contact there is substantially no braking effect. The braking effect is a function of the material used for the tooth 21 and detents 22, the depth to which the tooth 21 projects between the detents 22, and the shapes of the tooth 21 and detents 22.

FIG. 7 shows in the left-hand line graph the braking moment $M_D$ on the ordinate and the number n of revolutions of the spool 8 on the ordinate. In this arrangement the supply 12 is exhausted after 130 revolutions of the spool 8, and measurements are only taken after the second revolution of the spool 8 when the tape is actually being wound up and any initial set is past. The dot-dash line here plots the braking moment for a prior-art system having a toothed element like the tongue 20 that engages a flat surface of a spool so that with time the tooth wears down and the braking force increases as the contact area with the tooth increases. Thus in the prior-art system the braking effect is the exact opposite that which is needed as it will not augment tension at the start when it is needed, but will at the end when it can snap the tape.

The solid-line plots on the left-hand line graph of FIG. 7 show the braking-moment curves for teeth 21 according to this invention with 30°, 45°, and 60° teeth engaging with detents 22 of frustoconical shape. As can be seen, once the initial stiffness of the system is overcome the braking force decreases as the tape is used up. The right-hand bar graph of FIG. 7 indicates the final depth T of the notch 24 formed in the tooth 21, which depth is of course proportional to the braking force. Thus FIG. 7 illustrates how within the range of angles according to this invention the braking force corresponds exactly to what is needed: a large force at the start to keep the tape tight when the two spools 8 and 9 are rotating at about the same peripheral speed and a small force at the end when the wheel 9 is being driven quite a bit faster so that there is considerable slip in the clutch 28.

Figure 8:
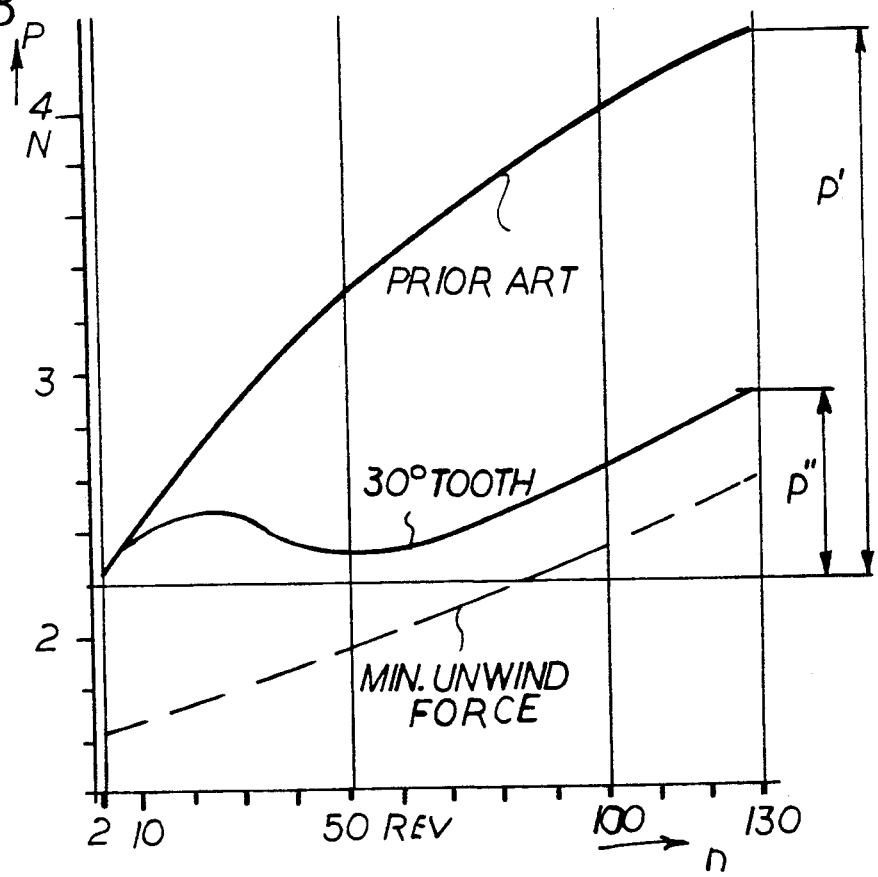
FIG. 8 is another graph further illustrating this invention.

FIG. 8 illustrates on the ordinate the force P necessary to pull out the tape, and once again on the abscissa the number n of revolutions The dashed-line curve shows the force necessary for unwinding due to the constantly oppositely changing effective diameters of the spools 8 and 9, this curve increasing regularly. The upper solid-line curve indicates the result of adding to this the tension in a prior-art system as shown in a dot-dashed line in FIG. 7, with an additional force P′ that can be great enough to break the tape. The lower solid-line curve of FIG. 8 shows the response with a 30° tooth according to this invention which, it is noted, exactly follows the desired dashed line curve at least during the latter portion of use of the supply and results in an additional force P″ which can easily be exerted by hand and which will pose no danger to the tape.

I claim:

1. A dispenser for a film carried on a tape, the dispenser comprising:

a cartridge;

a supply spool on which the tape carrying the film is wound, the supply spool being rotatable on the cartridge;

a takeup spool onto which the tape is wound, the takeup spool being rotatable on the cartridge adjacent the supply spool;

a guide on the cartridge over which the tape passes between the spools;

means engaged between the takeup spool and the cartridge for permitting the takeup spool to rotate only in a direction winding up the tape, whereby the tape can only move from the supply spool to the takeup spool to deplete the supply spool; and brake means for resisting rotation of the supply spool on the cartridge in a direction corresponding to unwinding of the tape from the supply spool with a force that, after a predetermined number of revolutions of the supply spool substantially smaller than the number of revolutions necessary to deplete the supply spool, decreases as the tape is unwound from the supply spool, the brake means including an annular array of detents formed on the supply spool, a tooth on the cartridge engageable with the detents and of a material which shows substantial wear after the predetermined number of revolutions of the supply spool and thereafter wears away as the supply spool rotates, biasing means for urging the tooth into engagement between the detents.

2. The dispenser defined in claim 1 wherein the tooth is pointed and engageable between the detents.

3. The dispenser defined in claim 1 wherein the biasing means is a tongue integrally formed on the cartridge and the supply spool has a side disk integrally formed with the detents.

4. The dispenser defined in claim 3 wherein the tooth is unitarily formed with the tongue.

5. The dispenser defined in claim 4 wherein the tooth is of triangular section.

6. The dispenser defined in claim 5 wherein the tooth has flanks meeting at an edge and defining an angle lying generally between 30° and 60°.

7. The dispenser defined in claim 4 wherein the supply spool is rotatable about and the array is centered on a common axis and the tongue extends tangentially of the axis at the array, whereby the tooth engages centrally between the detents.

8. The dispenser defined in claim 7 wherein the cartridge has a second such tongue and a second such tooth arranged generally diametrically relative to the axis to the first-mentioned tongue and the first-mentioned tooth.

9. The dispenser defined in claim 1 wherein the predetermined number is two.

10. In a single-use dispenser comprising:

a housing;

a supply spool rotatable about a spool axis on the housing; and a tape wound on the spool, the spool rotating about the axis in an unwinding direction on unwinding of the tape from the spool to deplete the tape wound on the spool; the improvement comprising an annular array of angularly spaced detents fixed on the spool and centered on the axis;

a braking element engageable with and deflectable by the detents, the element being of a material that is frictionally abradable by the detents such that after a predetermined number of revolutions of the spool in the housing substantially before depletion of the tape wound on the spool it abrades appreciably and resists rotation of the spool with a decreasing force; and means for resisting deflection of the element out of engagement with the detents with a predetermined generally constant force, whereby the element inhibits rotation in the unwinding direction of the spool.

11. The dispenser defined in claim 10 wherein the detents project axially from the spool and the element is axially deflectable.

12. The dispenser defined in claim 10 wherein the element has a V-shaped tooth engageable between the detents.

13. A dispenser for a film carried on a tape, the dispenser comprising:

a cartridge;

a supply spool on which the tape carrying the film is wound, the supply spool being rotatable on the cartridge and being formed with a side disk;

a takeup spool onto which the tape is wound, the takeup spool being rotatable on the cartridge adjacent the supply spool;

a guide on the cartridge over which the tape passes between the spools;

means engaged between the takeup spool and the cartridge for permitting the takeup spool to rotate only in a direction winding up the tape, whereby the tape can only move from the supply spool to the takeup spool to deplete the supply spool; and brake means for resisting rotation of the supply spool on the cartridge in a direction corresponding to unwinding of the tape from the supply spool with a force that, after a predetermined number of revolutions of the supply spool substantially smaller than the number of revolutions necessary to deplete the supply spool, decreases as the tape is unwound from the supply spool, the brake means including an annular array of detents formed on the supply spool, a tooth engageable with the detents, and biasing means including a tongue integrally formed with the cartridge for urging the tooth into engagement between the detents, the tooth and detents being frictionally engaged with each other and the tooth being of a material which wears away as the spool rotates.

14. The dispenser defined in claim 13 wherein the tooth is unitarily formed with the tongue.

15. The dispenser defined in claim 14 wherein the tooth is of triangular section.

16. The dispenser defined in claim 15 wherein the tooth has flanks meeting at an edge and defining an angle lying generally between 30° and 60°.

17. The dispenser defined in claim 15 wherein the cartridge has two such tongues and teeth arranged generally diametrically relative to the axis.

18. The dispenser defined in claim 14 wherein the supply spool is rotatable about and the array is centered on a common axis and the tongue extends tangentially of the axis at the array, whereby the tooth engages centrally between the detents.

* * * * *